US007980603B2

(12) United States Patent
Peabody et al.

(10) Patent No.: US 7,980,603 B2
(45) Date of Patent: Jul. 19, 2011

(54) ROTATING LATCH FOR LATCHING AND UNLATCHING A DOOR

(75) Inventors: Joshua Todd Peabody, Phoeniz, AZ (US); Dominik Scheffler, Pheonix, AZ (US); Lee J. Hanchett, Jr., Cave Creek, AZ (US); Scott Sullivan, Cave Creek, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 12/263,572

(22) Filed: Nov. 3, 2008

(65) Prior Publication Data

US 2010/0109349 A1 May 6, 2010

(51) Int. Cl.
*E05C 1/02* (2006.01)

(52) U.S. Cl. .. 292/137; 292/216; 292/201; 292/DIG. 23

(58) Field of Classification Search ..... 292/137, 292/216, 201, DIG. 23
See application file for complete search history.

(56) References Cited

U.S. PATENT DOCUMENTS

| | | | | |
|---|---|---|---|---|
| 2,768,014 | A | 10/1956 | Golden et al. | |
| 4,573,333 | A | 3/1986 | Choi | |
| 6,886,869 | B2 * | 5/2005 | Martinez et al. | 292/216 |
| 6,908,137 | B2 * | 6/2005 | Doxey et al. | 296/65.16 |
| 6,932,393 | B2 * | 8/2005 | Erices | 292/216 |
| 6,948,745 | B2 * | 9/2005 | Chevalier | 292/201 |
| 6,964,438 | B2 * | 11/2005 | Koike et al. | 292/201 |
| 7,219,935 | B2 * | 5/2007 | Edgar | 292/216 |

FOREIGN PATENT DOCUMENTS

| | | |
|---|---|---|
| DE | 7439056 U | 7/1976 |
| DE | 10207630 A1 | 9/2003 |
| GB | 2203794 | 10/1988 |
| WO | 2005088046 | 9/2005 |

OTHER PUBLICATIONS

Mendez, Perez J., "International Search Report," mailed on Jan. 22, 2010 for international application No. PCT/US09/063097, with the international filing date of Nov. 3, 2009, Rijswijk, Netherlands.

Mendez, Perez J., "Written Opinion of the International Searching Authority," mailed on Jan. 22, 2010 for international application No. PCT/US09/063097, with the international filing date of Nov. 3, 2009, Rijswijk, Netherlands.

* cited by examiner

*Primary Examiner* — Carlos Lugo
*Assistant Examiner* — Mark Williams
(74) *Attorney, Agent, or Firm* — Woods Oviatt Gilman LLP

(57) ABSTRACT

A locking system wherein the latch is rotatable to provide either a first beveled surface for use as a ramp in latching or a second beveled surface for use as a ramp in unlatching. An entire latch module may be rotated about its axis by a rotary solenoid to achieve this function, and the first and second ramping surfaces are physically the same surface repositioned by rotation 180°. Alternatively, a releasable latch has a beveled surface for engaging a striker plate during bolt entry and a non-beveled surface for locking. The latch is pivotable to allow the non-beveled surface to become the beveled ramp for unlocking. The releasably pivotable latch mechanism may be used with a deadlock. The mechanism is readily incorporated into a rim exit device for releasably securing a door such as an emergency exit and may be actuated either electrically or manually.

8 Claims, 5 Drawing Sheets

ROTATING LATCH FOR LATCHING AND UNLATCHING A DOOR

TECHNICAL FIELD

The present invention relates to a mechanism for latching a hinged door into a frame; more particularly, to a latch having a beveled surface for forcing retraction of the latch by engagement with a striker plate during latching; and most particularly, to an improved releasable latch wherein an element of a latch assembly is rotatable about an axis to provide either a first beveled surface for use in latching or a second beveled surface for use in unlatching.

BACKGROUND OF THE INVENTION

Existing electromechanical locking mechanisms such as electric strikes, electrified locks, and electrified rim exit devices incorporate electromechanical mechanisms that use some type of locking element such as a keeper, a latch bolt, or a pullman style latch bolt. In unlocking, the locking element (referred to generically herein as a "latch") is required to rotate or retract out of the way of the mating locking element to reach a state of being unlocked. The latch may be mounted in a door and the mating locking element (referred to herein generically as a "striker" or "striker plate") may be mounted on a door frame, or vice versa, to equal effect.

For electric strikes, unlocking is achieved either by the outward rotation of the keeper, which allows the locked latch to pass through the door frame, or by an internal mechanism designed to push the locked latch out of the door frame to allow the door to be opened. For electrified locks, unlocking is typically achieved by electromechanically unlocking the lock's knob or lever, thus allowing the user to manually retract the latch to open the door.

For electrified rim exit devices, unlocking is typically achieved by utilizing an electromechanical device actuated by a solenoid or motor, to draw a pullman-style latch bolt out of or away from the strike to release the locked door. These electromechanical devices are typically very large in size and aesthetically unpleasing, and they require a large amount of power or current to actuate the unlocking mechanism.

What is needed in the art is a locking device, and especially an electromechanical locking device, that can fit within a limited amount of functional space and still meet the force requirements, either electrical or manual, of a design that has moving parts and some degree of complexity to resist easy defeat.

It is a principal object of the present invention to provide an improved, compact locking device.

SUMMARY OF THE INVENTION

Briefly described, a locking system in accordance with the present invention includes an improved latch wherein an element of the latch is rotatable about an axis to provide either a first beveled surface for use as a ramp in latching or a second beveled surface for use as a ramp in unlatching.

In a first embodiment, an entire spring-loaded latch module is rotated about its horizontal axis to provide a first ramping surface for engaging the exterior entry edge of the striker plate during locking and a second ramping surface for engaging the interior locking edge of that same striker plate in unlocking. A rotary solenoid or clock motor is implemented to achieve this function. In this embodiment, the first and second ramping surfaces are physically the same ramping surface simply repositioned by rotation of the latch module 180°.

In a second embodiment, a releasable latch for mounting in a complementary door frame having a first beveled contact surface for engaging a complementary striker plate during door closing and a second non-beveled contact surface for locking. The object of this embodiment is to pivot the releasable latch in such a way as to allow the previously non-beveled locking surface of the latch to become the beveled ramp for unlocking the door just as the previously beveled surface of the latch was the beveled ramp for locking the door.

In locking, the releasable latch presents its beveled first contact surface to the exterior entry edge of a striker plate, allowing the force of door closing to drive the latch assembly axially to permit passage of the releasable latch past the striker plate. The assembly springs back into locking position upon alignment of the latch with an opening in the striker plate when the door is fully closed. The striker plate then engages the flat surface of the releasable latch to secure the door. In unlocking, a tip of the releasable latch is allowed to rotate at least 30° on a pivot axis orthogonal to the direction of latch rotation, such that the original flat contact surface of the releasable latch is now a beveled contact surface defining an exit ramp for allowing the force of door opening to drive the assembly axially to permit passage of the releasable latch past the striker plate.

In either the first or second embodiment, a ramp angle of about 30° to about 45° on the releasable latch is required to force the latch bolt assembly back to accomplish locking or unlocking. A further embodiment includes a dead latch mechanism wherein the releasable latch is rotated a full 90° about the pivot axis, thus re-positioning the latch out of the path of the striker plate and thereby precluding the need for any translation of the latch bolt in the unlocking mode.

The second embodiment further comprises a mechanism which allows the releasable latch to pivot at the appropriate (unlocking) times and to be held rigid and secure with the latch bolt at other (locking) times. Preferably, such a mechanism comprises a solenoid with its associated plunger, a pivotable keeper, and associated linkages, pivots, and springs, which components permit the latch tip to pivot to an angle of between 30° and 90°.

The mechanism described above may be readily incorporated into a rim exit device for releasably securing a door such as an emergency exit. The device may be actuated either electrically as just described or manually.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
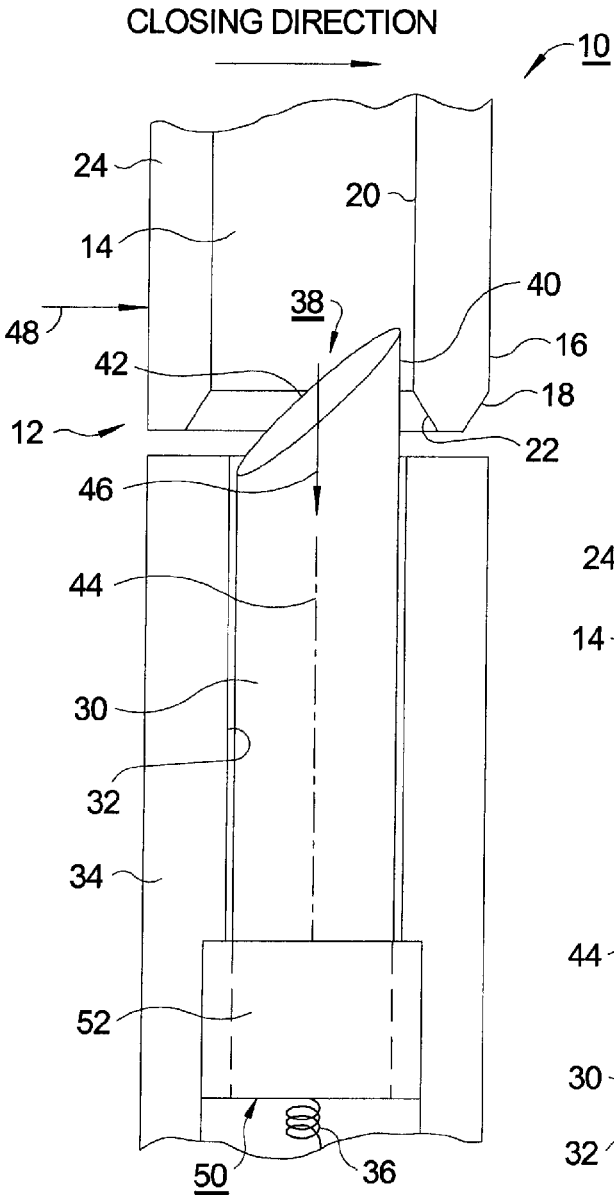
FIG. 1 is a cross-sectional view of a portion of a first embodiment of an electrically releasable latch system in accordance with the present invention, shown in locking mode.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

A dual function (translating and rotating) latch bolt lock system allows for bi-directional movement of the locking mechanism. This capability reduces the required amount of space and power needed for an electromechanical locking device to function.

In locking systems, an effective way to release a locked lock is simply to reverse the action of a latch bolt so that the locking edge of the latch bolt for holding the door closed becomes the beveled unlocking edge of the latch bolt for opening. To accomplish this, it is necessary either to rotate the entire latch bolt module on its horizontal axis so as to interchange the beveled and flat surfaces of the latch bolt, or to rotate the tip of the latch bolt in such a way as to allow the flat surface used to lock the door in its closed position to become the ramped unlocking surface for unlocking the door.

A first embodiment in accordance with the present invention comprises the electrification of a cylindrical lock mounted in a door frame for engaging a complementary striker plate mounted in a door. In this case, an electrical signal causes the latch bolt assembly to be rotated, thus allowing the lock set to release the door as from a remote location or as a result of a signal emanating from a keypad, badge reader, or other identification means.

Figure 2:
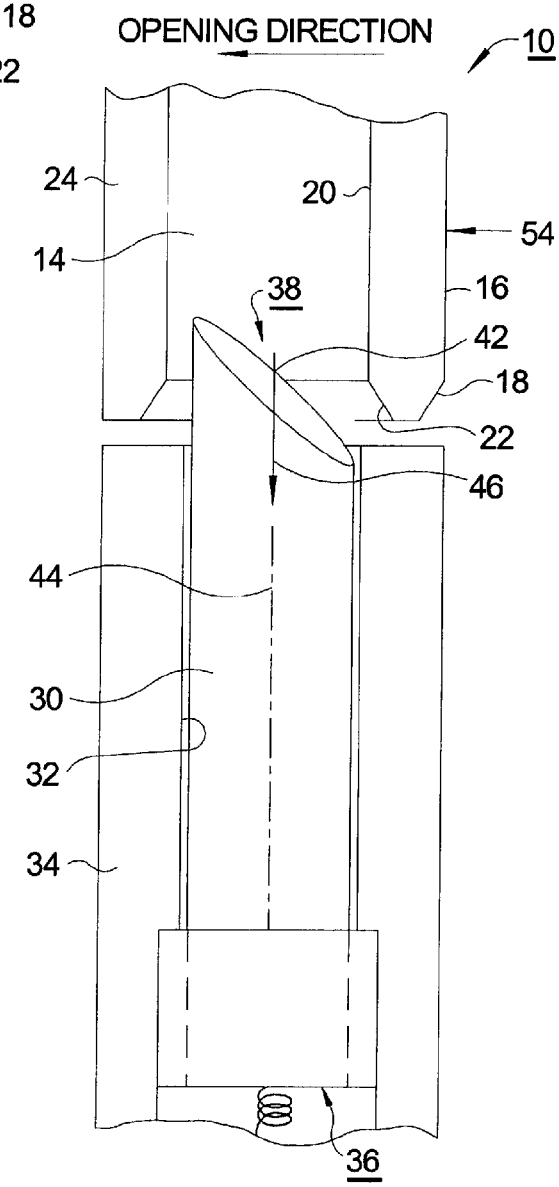
FIG. 2 is a view like that shown in FIG. 1, showing the assembly in unlocking mode.

Referring to FIGS. 1 and 2, in a first embodiment 10 of a releasable locking system in accordance with the present invention, a striker plate 12 is provided in door 24, as known in the art. Striker plate 12, in accordance with the invention, is disposed for receiving a selectably rotatable latch bolt 30, to be described. Striker plate 12 includes striker pocket 14 closing edge 16, which may include chamfer 18 and locking surface 20. Locking surface 20 may also include chamfer 22. Generally cylindrical latch bolt 30 is slidably disposed in a bore 32 in base plate 34 mounted in a complementary door frame and is urged outwards by a return spring 36. Striker pocket 14 receives latching tip 38 of latch bolt 30 wherein latch bolt 30 is latched by engaging locking surface 20 of striker plate 12 substantially parallel with the corresponding surface 40 of latch bolt 30. Latch bolt 30 is further provided with a diagonal latching/delatching face 42 formed at an angle, as for example approximately 45°, to the axis 44 of bolt 30.

In locking operation, face 42 is engaged by chamfer 18 of closing edge 16 of door 24 generating a force vector 46 along axis 44. Continued closing force 48 causes the force vector to overcome the force of spring 36, causing bolt 30 to slide in bore 32 until the end of latching tip 38 clears closing edge 16. Continued motion of the door causes the latching tip to pass by the plane of locking surface 20, allowing bolt 30 to enter pocket 14 and be retained therein as described above.

First embodiment 10 further comprises a rotary-acting solenoid 50, or a motor clutch arrangement, having a rotor 52 attached to latch bolt 30. When solenoid 50 is de-energized, bolt 30 is disposed for locking as shown in FIG. 1. However, energizing of solenoid 50 as by a signal generated by a push-button, entry card, or other recognition device (none shown) causes rotor 52 and bolt 30 to rotate 180° in bore 32, as shown in FIG. 2, placing latching/delatching face 42 adjacent locking surface 20 and in engagement with chamfer 22. In this position, an opening force 54 on door 24 again generates a force vector 46 along axis 44. Continued opening motion causes the force vector to overcome the force of spring 36 causing bolt 30 to slide in bore 32 until the end of latching tip 38 clears closing edge 16. Continued opening motion then causes the latching tip to pass by the plane of edge 16, allowing bolt 30 to clear door 24.

In a second embodiment, the interchange of the locking and unlocking surfaces on the latch bolt is accomplished by introducing a pivot point near the tip of a releasable latch so that in locked position the latch presents a flat surface to the locking edge of a complementary striker plate in the door and in a second instance provides a beveled surface to the striker plate. To this arrangement is added a mechanism which allows the latch tip to pivot at the appropriate times and to be held rigid and secure at other times.

Figure 3:
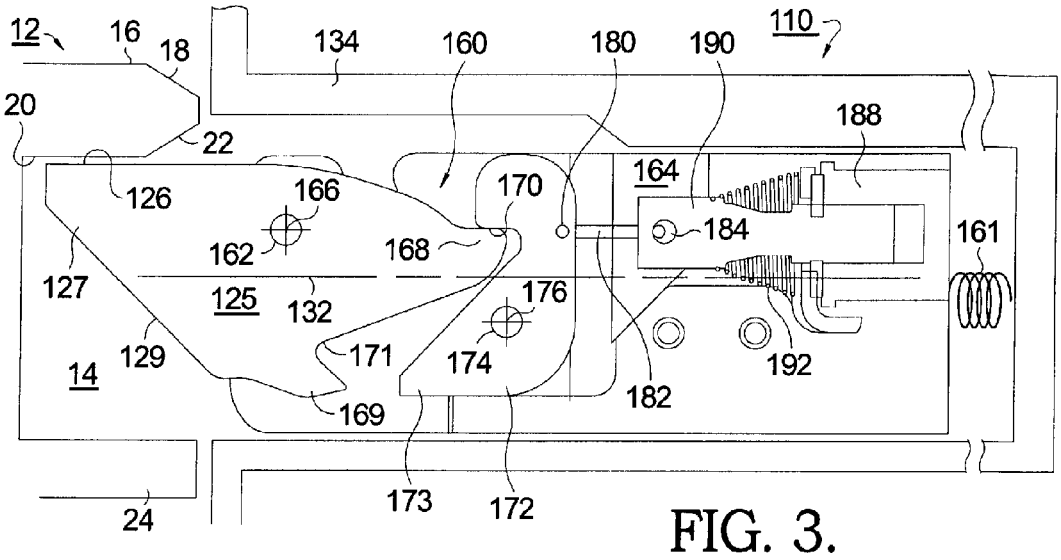
FIG. 3 is a cross-sectional view of a second embodiment of an electrically releasable latch system in accordance with the present invention, shown in locking mode.
Figure 4:
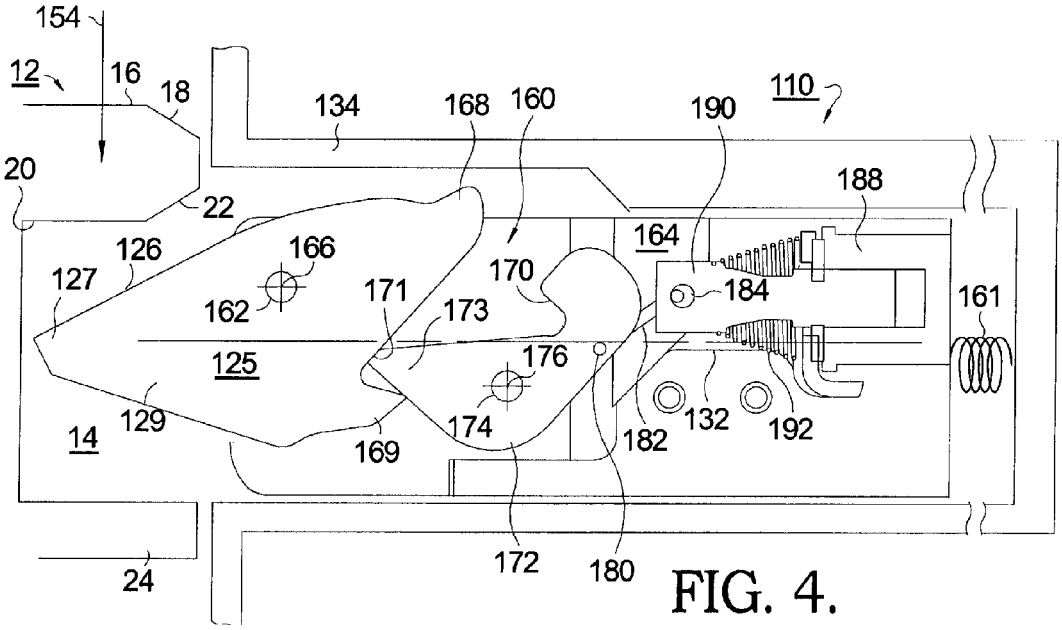
FIG. 4 is a view like that shown in FIG. 3, showing the system in unlocking mode.

Referring now to FIGS. 3 and 4, in second embodiment 110 of a releasable locking system in accordance with the present invention, a striker plate 12 is provided in door 24. Striker plate 12, is disposed for receiving a releasable latch 125 having a selectably pivotable latch tip 127, to be described. Striker plate 12 includes striker pocket 14 closing edge 16, which may include chamfer 18 and locking surface 20. Locking surface 20 may also include chamfer 22. A base plate 134 mounter in a door frame is provided complementary to striker plate 12 for receiving as a modular unit electrically releasable latch assembly 160, in accordance with the present invention. Releasable latch assembly 160, mounted on backing plate 164, is slidably disposed in base plate 134. Compression spring 161 disposed between latch assembly 160 and base plate 134 biases latch assembly 160 toward the left as shown in FIGS. 3 and 4. Movement of latch assembly 160 toward the right, against spring 161, along latch assembly axis 132, permits latching and unlatching of the door, as will be described below.

Releasable latch 125 is disposed on a first pin 162 disposed on the backing plate 164 for rotation about a first pin axis 166. Releasable latch 125 includes a feature such as first tang 168 that is selectively engaged by a corresponding mating feature such as first notch 170 formed in a keeper 172 rotatably mounted on a second pin 174 also extending from plate 164 for rotation about a second pin axis 176. Linearly actuating solenoid 188 is disposed to selectively move keeper 172 from a first locking position shown in FIG. 3 to a second unlocking position shown in FIG. 4. Solenoid 188 includes plunger 190. Keeper 172 includes a orifice 180 engageable by a first end of link 182. A second end of link 182 engages orifice 184 disposed in plunger 190. Releasable latch 125 is provided with a spring (not shown) that biases it for rotation in a clockwise direction. Solenoid spring 192 biases plunger 190 in a left direction, as shown in FIGS. 3 and 4. Optionally, keeper 172 may be provided with a spring (not shown) that biases it for rotation in a counter-clockwise direction.

In FIG. 3, it will be seen, when solenoid 188 is de-energized, first tang 168 of releasable latch 125 is engaged by first notch 170, thus defining a locking condition for assembly 160. In its locking condition, releasable latch 125 is prevented from rotating counterclockwise to allow locking surface 20 of striker plate 12 from moving past surface 126 of latch tip 127. That is, surface 126 remains in a locked position substantially in a parallel, abutting relationship with locking surface 20. In this abutting relationship, the opening force of the door applied to surface 126 remains normal to surface 126 and translation of latch assembly 160 along axis 132 is prevented, thus preventing the door from being opened Referring now to FIG. 4, in releasing latch 125 to permit counterclockwise rotation thereof, solenoid 188 is energized, allowing keeper 172 to rotate clockwise which unlocks first tang 168 from engagement by keeper notch 170. When an opening force 154 is applied to door 24, locking surface 20 of the strike plate applies a force to surface 126 causing releasable latch 125 to rotate in a counter-clockwise direction. Second tang 169 and second notch 171 of latch 125 contact third tang 173 of keeper 172 causing releasable latch 125 to assume the rotational position shown in FIG. 4 wherein surface 126 assumes an angular position, relative to axis 132, of approximately 30° to 45°. Continued movement of the door in the opening direction allows surface 126 of latch tip 127 to slide along chamfer 22 of locking surface 20 thereby pushing assembly 160 against compression spring 161. Continued opening movement of the door and continued movement of assembly 160 against spring 161 permits latch tip 127 to clear closing edge 16 of strike plate 12. Note that surface 126 which was formerly a non-beveled locking surface in the latch's lock position is transformed into an opening surface beveled at an angle to axis 132 when the solenoid is energized.

To close and lock the door, solenoid 188 is de-energized. Keeper 172 rotates in a counter-clockwise direction to a position shown in FIG. 3 under the extending force of solenoid spring 192. The clockwise force of the releasable latch bias spring (not shown) causes releasable latch 125 to assume the rotational position shown in FIG. 3. Continued movement of the door in the closing direction allows chamfer 18 of closing edge 16 of striker plate 12 to slide along beveled surface 129 of latch tip 127 thereby pushing assembly 160 against compression spring 161. Continued closing movement of the door and continued movement of assembly 160 against spring 161 permits latch tip 127 to clear locking surface 20 of striker plate 12, thereby locking the door. Note that, in the operation of this embodiment, the roles of surfaces 126 and 129 are reversed. Surface 126 is the beveled surface for allowing the door to open, and surface 129 becomes the beveled surface for returning the door to a locked position.

While the actuator for providing selective movement of the keeper has been described as a linear solenoid, a rotary solenoid for providing rotational movement to the keeper about the keeper's axis may also be used within the scope of the invention as well as any other actuator, whether electrical or not.

It will be obvious that the just-described assembly 160 may be configured as a surface mount for installation on a door frame interacting with a locking strike plate on the door, as described or, conversely, for installation in a door with the complementary locking strike mounted on a door frame. Furthermore, it may be installed on a gate with assembly 160 on the gate post, or vise-versa.

Figure 5:
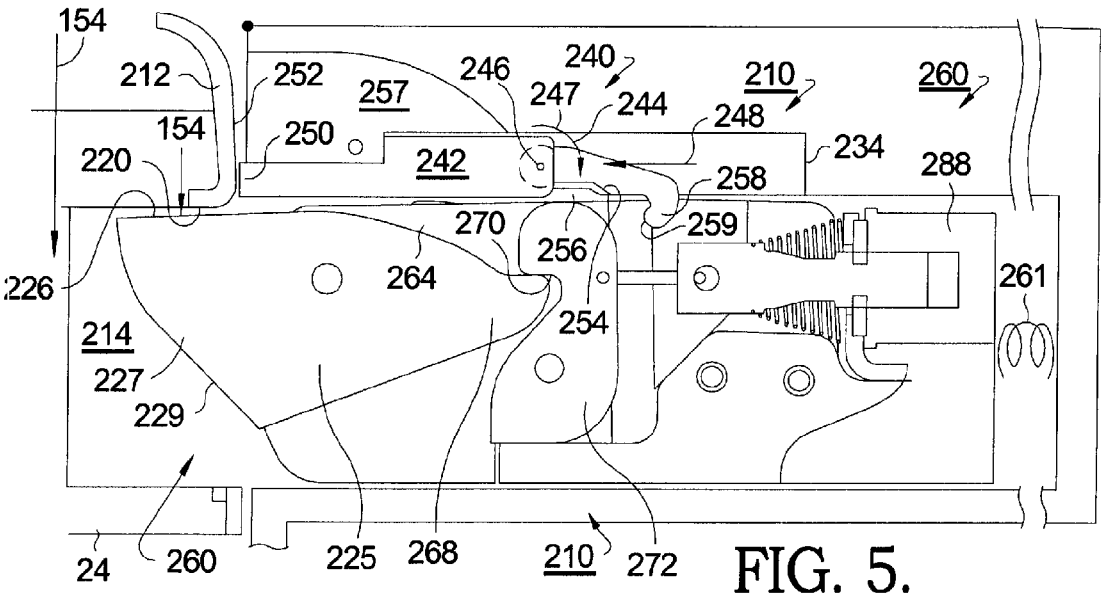
FIG. 5 is a cross-sectional view of an electrically releasable latch system, similar to that shown in FIG. 3, with a deadlock mechanism.
Figure 6:
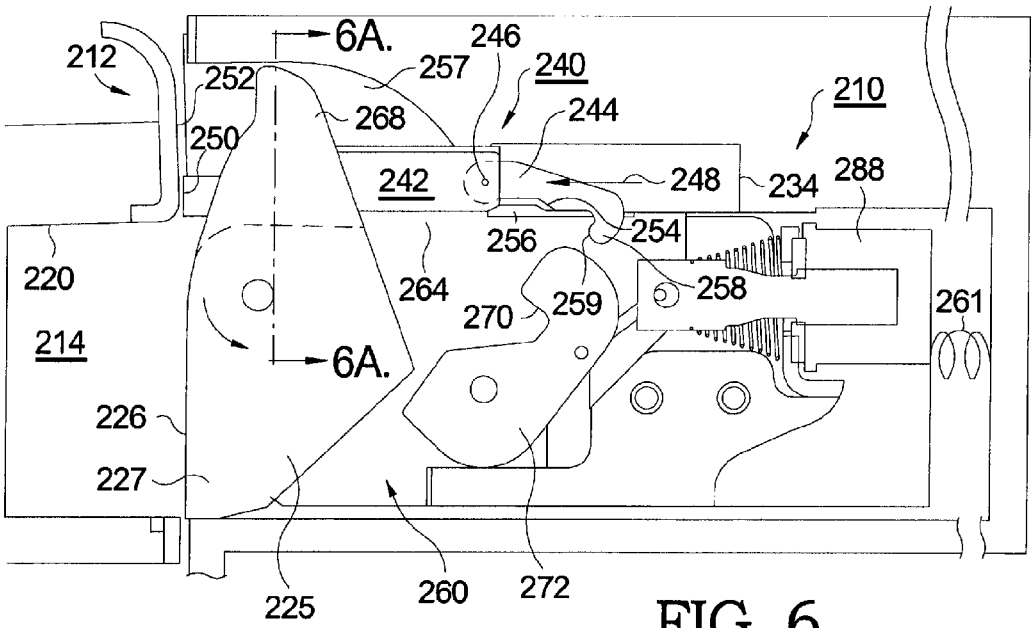
FIG. 6 is a view like that shown in FIG. 5, in unlocking mode.
Figure 7:
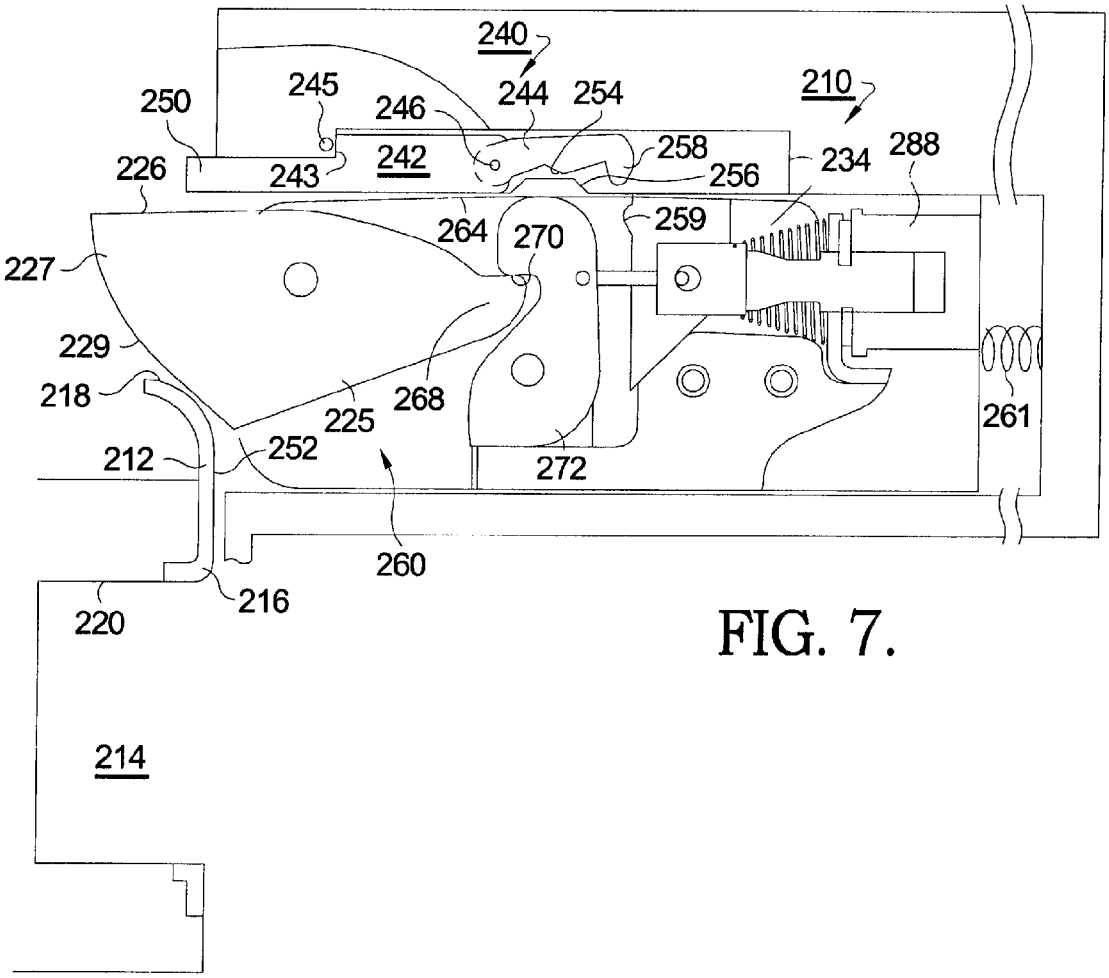
FIG. 7 is a view like that shown in FIG. 5, shown in latching mode.

It is known in the art to deadlock a latch mechanism in a striker plate, by a trigger bolt or dog, in order to prevent unwanted inward movement of the latch against the latch mechanism return spring when the latch is engaged with the striker plate. For example, see U.S. Pat. No. 2,768,014. In such a mechanism, the trigger bolt, when blocked from extending into the striker pocket with the latch, locks the latch from being unwontedly forced out of the pocket against the return spring by a thin object or tool inserted between the striker plate and latch base plate such as a credit card. FIGS. 5 through 7 adapts a deadlock feature to the pivoting releasable latch disclosed in FIGS. 3 and 4.

Referring to FIG. 5, third embodiment 210 having a deadlock mechanism 240 coupled to pivoting latch assembly 260 is shown. It will be readily seen that, when solenoid 288 is de-energized, first tang 268 on releasable latch 225 is engaged by first notch 270 of keeper 272, thus defining a locking condition for assembly 260. In its locking condition, releasable latch 225 is prevented from rotating counterclockwise to allow locking surface 220 of striker plate 212 from moving past surface 226 of latch tip 227. That is, surface 226 remains in a locked position substantially in a parallel, abutting relationship with locking surface 220 thus preventing the door from being opened.

Referring to the embodiment shown in FIG. 3, it is known that, in the locked condition shown, the releasable latch can be forced out of striker pocket 14 by slipping a thin tool such as a credit card through the gap between door 24 and base plate 134 to contact latch tip 127 of releasable latch 125. By applying pressure to either beveled surface 129 or surface 126 with the edge of the credit card, releasable latch assembly 160 can be manipulated rightward along its axis 132 against compression spring 161 to disengage latch tip 127 from pocket 14, thereby unlocking the door. Deadlock mechanism 240 prevents rightward movement of the latch assembly when releasable latch is engaged in the pocket of the striker plate.

Referring again to FIG. 5, deadlock mechanism 240 includes actuating pin 242 and trigger 244 pivotably attached to actuating pin 242 by axle 246 and is biased by a torsion spring (not shown) to rotate relative to actuating pin 242 in the direction shown as 247. Actuating pin 242 is slidably held in place against backing plate 264 by a groove (not shown). A compression spring (not shown) disposed between actuating pin 242 and base plate 234 thereby biasing actuating pin 242 in its mating groove in the direction shown as 248. In the closed door position, when releasable latch 225 is engaged in striker pocket 214 as shown in FIG. 5, tip 250 of actuating pin 242 contacts surface 252 of striker plate 212 under the force of the actuating compression spring (not shown) thereby preventing further leftward movement of actuating pin 242. In the position shown, a first ramp surface 254 on trigger 244 is stopped from engaging a second ramp surface 256 on backing plate 264. Pawl 258 of trigger 244 is thus biased in direction 247 to engage notch 259 in backing plate 264. Thus, latch assembly 260 is prevented from moving rightward against compression spring 261, and unwanted disengagement of releasable latch 225 from striker pocket 214 is prevented as well.

Figure 6A:
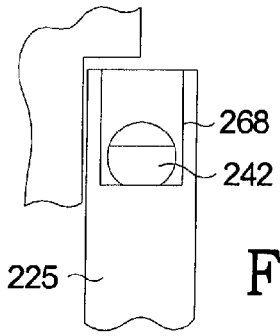
FIG. 6A is a sectional view of the deadlock mechanism and latch, taken along line 6A-6A in FIG. 6.

Referring now to FIG. 6, in releasing latch 225 to permit counterclockwise rotation thereof, solenoid 288 is energized, allowing keeper 272 to rotate clockwise which unlocks first tang 268 from engagement by keeper notch 270. When an opening force 154 (FIG. 5) is applied by door 24, locking surface 220 of the striker plate applies a force to surface 226 causing releasable latch 225 to rotate in a counter-clockwise direction against a biasing torsion spring (not shown). Releasable latch 225 is forced to rotate approximately 90° by striker plate 212 to assume the position shown in FIG. 6. Note that, to permit a full 90° rotation of releasable latch 225, second tang 169 and third tang 173 (as shown in FIGS. 3 and 4) are removed. Also, as shown in FIG. 6A, first tang 268 of releasable latch 225 is bifurcated to receive actuating pin 242 at full 90° rotation. Further, scalloped clearance slot 257 (FIGS. 5 and 6) is provided in base plate 234 to receive rotated first tang 268. It is an important feature of the embodiment shown in FIG. 6 that, when solenoid 288 is activated to permit 90° rotation of rotatable latch 225, trigger 244 remains engaged in notch 259 to prohibit rightward movement of latch assembly 260.

Referring to FIG. 7, to return the door to a locked position after opening, solenoid 288 is de-energized. The clockwise force imposed by the releasable latch bias spring (not shown) causes first tang 268 of releasable latch 225 to re-engage first notch 270 of keeper 272. Since striker plate 212 and striker pocket 214 are no longer in position to receive latch tip 227, and tip 250 of actuating pin 242 is no longer in contact with striker plate 212, actuating pin 242 moves leftward in direction 247 under the force of the actuating pin compression spring (not shown). First ramp surface 254 rides up on second ramp surface 256 until actuating pin ledge 243 comes in contact with stop pin 245 thereby inhibiting further leftward movement of actuating pin 242. In the position shown in FIG. 7, contact between ramps 254,256 causes trigger 244 to rotate counter-clockwise against its biasing torsion spring (not shown). Pawl 258 becomes disengaged from notch 259 thereby once again permitting rightward translation of retractable latch assembly relative to backing plate 264. Continued movement of the door in the closing direction allows bull nose section 218 of closing edge 216 of striker plate 212 to slide along beveled surface 229 of latch tip 227 thereby pushing assembly 260 against compression spring 261. Continued closing movement of the door and continued movement of assembly 260 against spring 261 permits latch tip 227 to clear locking surface 220 of striker plate 212, thereby locking the door. Note that, in the operation of this embodiment, rotatable latch 225 rotates 90° for allowing the door to open, and beveled surface 229 is used for returning the door to a locked position.

Figure 8:
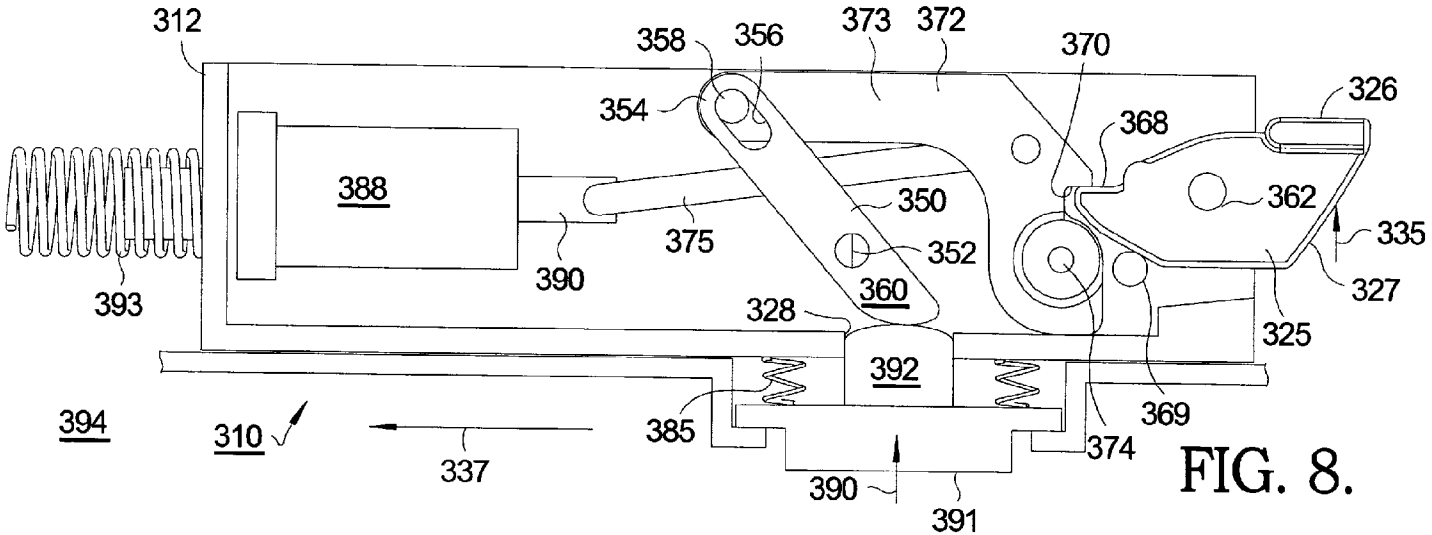
FIG. 8 is a cross-sectional view of an electrically-actuated/manual override releasable rim exit locking system shown in locking mode.
Figure 9:
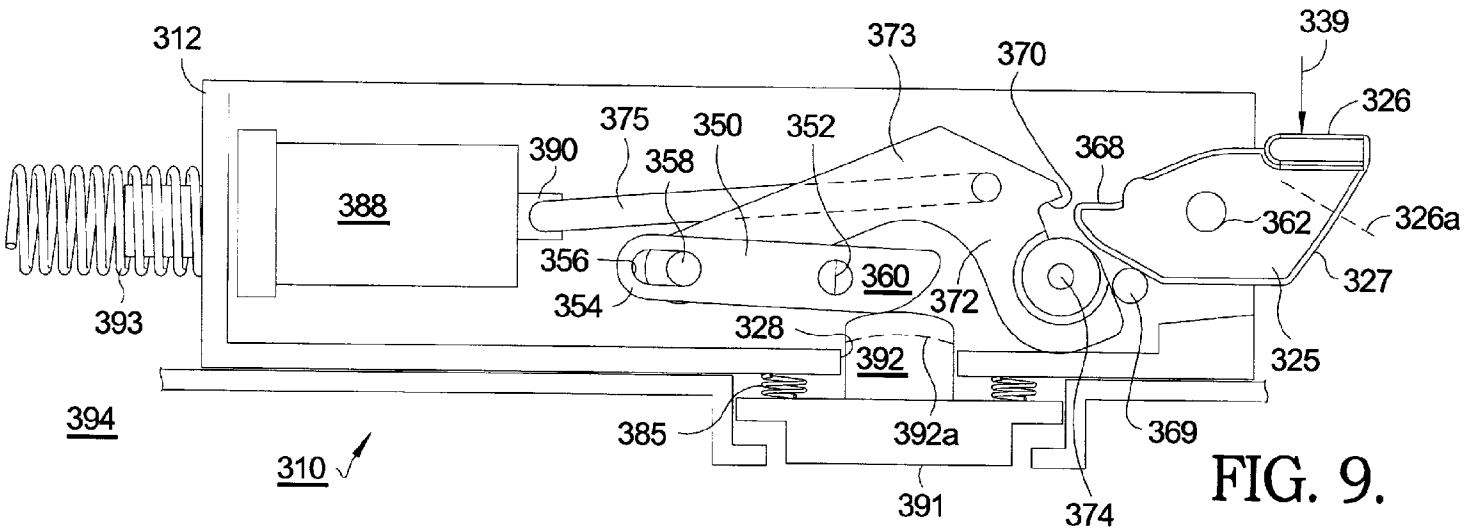
FIG. 9 is a view like that shown in FIG. 8, in unlocking mode.

Referring now to FIGS. 8 and 9, an exemplary solenoid actuated, manual override rim-exit releasable latch system 310 in accordance with the present invention comprises a body 312 slidably mountable on or in a door 394. A releasable latch 325, having a beveled first entry surface 327, second locking surface 326 and tang 368, is pivotably mounted on a first pin 362. Releasable latch 325 includes a bias spring (not shown) for urging rotation of latch 325 in a counter-clockwise direction against stop 369. A keeper 372 having a notch 370 is pivotably disposed on a second pin 374. In locking position as shown in FIG. 8, tang 368 is engaged by notch 370, thus preventing rotation of releasable latch 325. Keeper 372 includes an arm 373 rotatably connected to a link 375 rotatably connected to a linear solenoid 388. Solenoid 388 may be actuated remotely by a signal generated by a push button, entry card, or other recognition device. Panic bar 391, also known colloquially in the art as a "crash bar", is mounted to a surface of door 324 for reciprocating movement in the direction 390 shown in FIG. 8. One or more springs 385 bias panic bar 391 in a direction away from the surface of door 324. Panic bar 391 includes nose portion 392 protruding through an opening 328 in the surface of door 324. Lever 350, pivotably disposed on a third pin 352, includes a first end 354 slidably connected, via slot 356, to pin 358 in arm 373. Nose portion 392 of panic bar 391 makes contact with a radiused edge on a second end 360 of lever 350.

In locking operation, system 310 functions like spring-loaded latch assembly as described above wherein closing force 335 imposed on beveled first entry surface 327 by a striker plate (not shown) causes system 310 to slide axially in a lateral direction 337 to clear the striker plate, whereupon a spring 393 returns system 310 to locked position within the striker plate.

Referring now to FIG. 9, in operation, when panic bar 391 is urged against second end of lever 350, it causes a counter-clockwise rotation of lever 350 and, through pin 358, a counter-clockwise rotation of keeper 372. When notch 370 of keeper 372 disengages from tang 368 of releasable latch 325, latch 325 is no longer prevented from rotation and thus is free to rotate clockwise in response to an opening force 339 applied to second locking surface 326 of release latch 325. It will be seen that, in accordance with the present invention, locking surface 326 is transformed by rotation of latch 325 into a beveled unlocking surface (shown as a dotted line 326*a*) that causes system 310 to slide axially to clear the striker plate (not shown) in opening of the door. This arrangement enables a door to open more quickly than the common prior art panic device utilizing a Pullman latch because opening of the door is not dependent on the latch being completely rotated parallel to the surface of the static door frame or mullen.

Still referring now to FIG. 9, a solenoid actuation of the mechanism 310 is shown, wherein nose portion 392*a* (shown in dotted line) is in its position shown in FIG. 8. Keeper 372 includes a first orifice for rotatably receiving a first end of link 375. Solenoid plunger 390 includes a second orifice for rotatably receiving a second end of link 375. Actuation of solenoid 388, which may be remotely actuated, causes counter-clockwise rotation of keeper 372. When notch 370 of keeper 372 disengages from tang 368 of release latch 325, latch 325 is no longer prevented from rotation and thus is free to rotate clockwise in response to an opening force 339 applied to second locking surface 326 of release latch 325. It will be seen that, opening of the door via actuation of panic bar 391 overrides solenoid actuation of the system without functionally inhibiting the ability of the solenoid to actuate the system as well.

While the various embodiments have been described as actuate-able by a powered actuator such as, for example, a linear solenoid or a rotary solenoid, it is understood that the embodiments may be actuated by any type of force such, for example, a vacuum motor, or by human force only.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for releasably locking a door into a door frame, the system comprising:

a) a strike plate including a locking surface, wherein one of the door and the door frame includes said strike plate; and b) a latch module, wherein the other of the door and the frame includes said latch module, said latch module comprising a releasable latch and a keeper, said releasable latch pivotably mounted for rotation about a first axis, said releasable latch including a first tang and a first notch, said releasable latch including a first surface and a second surface disposed at a first non-parallel angle relative to said first surface; and said keeper pivotally mounted for rotation about a second axis, said keeper defining a second notch for engaging said first tang when said latch module is in a locking position, said keeper including a second tang that is in contact with said first notch when said latch module is in an unlocking position, wherein said first surface is substantially parallel with the locking surface when said latch module is in said locking position, wherein said first surface is positioned at a second non-parallel angle relative to the locking surface when said latch module is in said unlocking position, and wherein said releasable latch includes a third tang and wherein said second tang of said keeper is in contact with both said third tang and said first notch when said latch module is in said unlocking position; an actuator connected for movement of said keeper.

2. A system in accordance with claim 1 wherein said actuator is an electric solenoid.

3. A system in accordance with claim 1 wherein said actuator is a rotary actuator.

4. A system in accordance with claim 1 wherein said latch module is disposed for lateral translation within a base plate.

5. A system in accordance with claim 1 wherein said second non-parallel angle is between 30° and 45°.

6. A system in accordance with claim 1 wherein said second non-parallel angle is 30°.

7. A system in accordance with claim 1 wherein said first surface is in abutting relationship with the locking surface in said locking position.

8. A system in accordance with claim 1 wherein said first non-parallel angle is about 45°.

* * * * *